United States Patent [19]

Forsgren

[11] Patent Number: 4,846,740

[45] Date of Patent: Jul. 11, 1989

[54] OUTBOARD MOTOR TILT MECHANISM

[75] Inventor: Lyle M. Forsgren, Oshkosh, Wis.

[73] Assignee: Brunswick Corporation, Skokie, Ill.

[21] Appl. No.: 218,654

[22] Filed: Jul. 13, 1988

[51] Int. Cl.[4] ..... B63H 1/14

[52] U.S. Cl. ..... 440/53; 440/63

[58] Field of Search ..... 440/53, 55, 56, 58–65; 248/640, 642, 643

[56] References Cited

U.S. PATENT DOCUMENTS

| | | | |
|---|---|---|---|
| 4,331,430 | 5/1982 | Lutzke et al. | 440/53 |
| 4,402,675 | 9/1983 | Eichinger | 440/53 |
| 4,472,148 | 9/1984 | Kollock et al. | 440/53 |
| 4,637,800 | 1/1987 | Slattery | 440/55 |

*Primary Examiner*—Joseph F. Peters, Jr.
*Assistant Examiner*—Jesûs D. Sotelo
*Attorney, Agent, or Firm*—Andrus, Sceales, Starke & Sawall

[57] ABSTRACT

An outboard motor tilt mechanism includes a tilt position bracket pivotally attached to the motor swivel bracket and operatively attached to the fixed motor transom bracket such that upward rotation of the swivel bracket provides step-wise engagement between tilt position notches in the tilt position bracket and abutment means on the transom bracket. A control bracket mounted for limited rotation with and frictional engagement of the tilt position bracket operates to prevent reengagement of a tilt position notch once the swivel bracket has been rotated upwardly past the point of initial engagement such that return downward rotation to the lower operating position is effected automatically. The mechanism may be configured to provide automatic latching in the uppermost trailering position with either manually effected or automatic return therefrom to the lower operating position.

12 Claims, 2 Drawing Sheets

OUTBOARD MOTOR TILT MECHANISM

BACKGROUND OF THE INVENTION

The present invention relates to a mechanism for tilting an outboard motor in a vertical plane relative to its mounting bracket and for holding the motor in and releasing it from selected tllt positions. More particularly, the invention pertains to a simplified tilt mechanism which provides automatic latching and return from intermediate tilt or trim positions and automatic latching in the uppermost or maximum tilt position.

Various outboard motor tilt mechanisms are disclosed in the prior art, all of which are intended to provide some combination of preset tilt positions, temporary movement from and return to the lower operating position, latching in an uppermost or maximum tilt position, and adjustment of the various positions. U.S. Pat. Nos. 4,331,430 and 4,472,148 describe similar mechanisms for providing a variety of outboard motor tilt positions. The positions typically include a series of lower trim positions, one or more shallow water drive positions, and an uppermost trailering position. These patents describe alternate mechanisms for selecting and establishing the various tilt positions and for moving the motor between them.

In U.S. Pat. No. 4,331,430, a tilt mechanism is described which includes a ratchet mechanism allowing the motor to be raised to a higher trim or shallow water position by simply tilting the motor about a horizontal axis and releasing it at the desired trim position. The motor may be returned to a lower trim position by tilting it beyond the highest trim or shallow water position, whereupon the ratchet mechanism engages a return cam surface which directs the return of the motor to its lowest trim position. An override lever may be manually engaged and held to temporarily disengage the ratchet mechanism while the motor is simultaneously being tilted, thereby allowing th emotor to be lowered without tilting to the highest position and utilizing the return cam surface.

The foregoing apparatus, though adequately providing the intended functions, is cumbersome and inconvenient to operate under certain conditions encountered in use. For example, direct automatic return of the motor from an upper trim position to its original lower operating position is not possible. The operator must either continue to tilt the motor up beyond the highest trim position and allow it to return via the return cam surface, or simultaneously engage a ratchet override lever while tilting the motor in an initial upward direction and allowing it to return directly down to the lower operating position. Both of the alternative procedures are awkward and somewhat cumbersome to undertake.

U.S. Pat. No. 4,472,148 provides an improvement to some of the functions in U.S. Pat. No. 4,331,430. Thus, the mechanism of U.S. Pat. No. 4,472,178 allows the operator to select and preset a number of lower operating or trim positions to which the motor will return directly when it is tilted down. However, the mechanism is subject to the same awkward and cumbersome operational aspects previously described. Also, both mechanisms are mechanically complex and require a substantial number of operating components.

U.S. patent application Ser. No. 178,564, filed Apr. 7, 1988, entitled "Tilt Mechanism for Outboard Motors", and assigned to the assignee of the present invention, discloses a tilt mechanism intended to correct the operational deficiencies in the two above described prior art mechanisms. Thus, the mechanism of Ser. No. 178,564 allows the operator to pivot the motor from any preset operating position temporarily to any higher position and still return directly to the original operating position Separate apparatus is also provided to allow the motor to be selectively moved to and held in a higher position, but such apparatus must be manually engaged and disengaged and requires the addition of another multi-part mechanism to the overall apparatus. Functional improvement is provided, but at the expense of additional complexity.

U.S. Pat. No. 4,637,800 discloses a more simplified tilt mechanism for an outboard motor which allows the motor to be tilted up from a lower operating position to a shallow water position where it may be locked and temporarily held. A separate manually operated control lever is used to either release the motor from its lower operating position for manual upward tilting or to release the motor from its upper shallow water position for manual return to the operating position. This mechanism includes no provision for intermediate step wise movement of the motor between the lower operating and intermediate upper trim, shallow water, or tilt positions.

The prior art is thus characterized by tilt mechanisms which attempt to provide a wide range of functions but are mechanically complex, and mechanically simple mechanisms which are very limited in the functions provided.

SUMMARY OF THE INVENTION

The tilt mechanism of the present invention provides the most important of the automatic functions provided by prior art tilt mechanisms with a mechanism that is simple and includes very few components. The present mechanism provides automatic latching in and return from one or more upper shallow water or trim positions and automatic latching in the uppermost tilt position.

The tilt mechanism may be applied to a conventional outboard motor including a transom bracket for attachment to a boat transom and a swivel bracket carrying the motor and pivotally attached to the transom bracket for rotation about a first horizontal axis between a lower operating position and an upper maximum tilt position. A tilt position bracket is pivotally attached to the swivel bracket for rotation about a second horizontal axis and the tilt position bracket includes a slot defining a two-sided cam track, one side of which defines a series of spaced tilt position notches and the opposite side of which defines a smooth return surface. A cam track follower is attached to the transom bracket and extends into the cam track for movement therein in response to the rotation of the swivel bracket in a manner such that engagement between the cam track follower and the cam track causes rotation of the tilt position bracket about the axis of its attachment to the swivel bracket A control bracket is pivotally attached to the tilt position bracket and the swivel bracket for rotation about the common horizontal axis. The control bracket is adapted to frictionally engage the tilt position bracket such that the two ordinarily rotate together with respect to the swivel bracket. A resilient biasing means operates to rotate the control bracket and the frictionally engaged tilt position bracket in a direction which causes the side of the cam track including the tilt position notches to be biased into engagement with the cam track follower as the latter moves in the cam track in response to upward rotation of the swivel bracket.

A first stop attached to the swivel bracket is engaged by the control bracket as the control bracket and frictionally attached tilt position bracket are rotated in the other direction in response to upward rotation of the swivel bracket from its lower operating position. Engagement of the first stop by the control bracket causes relative rotation between the control bracket and the tilt position bracket as the swivel bracket continues to be rotated upwardly. A second stop is also attached to the swivel bracket and is engageable by the control bracket in response to downward rotation of the swivel bracket to limit rotation of the combined control bracket and tilt position bracket in the first direction and prevent engagement between the cam track follower and the tilt position notches as the follower moves in cam track in response to downward return of the swivel bracket to the lower operating position The first and second stops which are disposed on opposite sides of the control bracket operate to limit the extent of combined rotational movement of the control bracket and frictionally attached tilt position bracket, but to allow independent rotation of the tilt position bracket in response to swivel bracket movement in either the upward or downward direction. Continued rotation of the tilt rotation bracket relative to the control bracket when the latter is in engagement with one of the stops permits automatic indexing of the tilt position notches with respect to the cam track follower in response to upward movement of the swivel bracket to provide automatic latching at any tilt position. Continued upward movement of the swivel bracket past any intermediate latched position provides further relative rotation between the tilt position bracket and the control bracket which restricts rotation of the combination under the influence of the resilient biasing means, thereby precluding relatching at that position and allowing automatic return to the lowermost operating position in response to downward movement of the swivel bracket.

The cam track may be located in either the tilt position bracket or the transom bracket and the cooperating follower attached to the other of the tilt position or transom brackets. The tilt position bracket may alternately be pivotally attached to the transom bracket with either the cam track or the cam track follower on the swivel bracket. The notch defining the upper maximum tilt position may be constructed to positively latch the swivel bracket against displacement from that position and utilize a manually operated release to unlatch it, or may utilize an automatic unlatching and return function similar to that provided with respect to the intermediate tilt position notches

DETAILED DESCRIPTION OF THE PREFERRED EMBODIMENT

Figure 1:
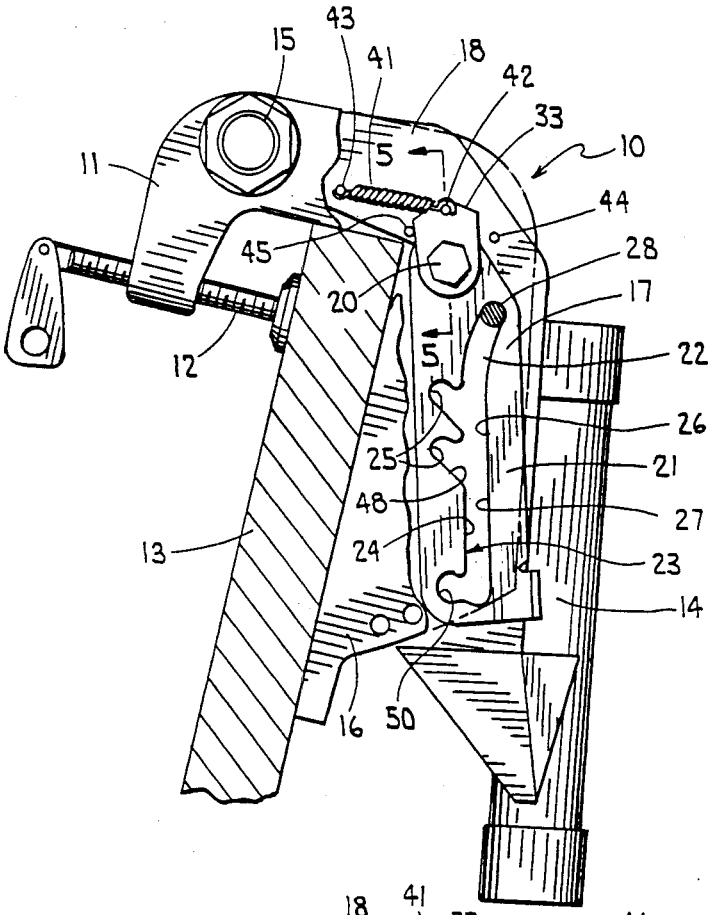
FIG. 1 is a sectional side elevation of the tilt mechanism of the present invention set in the lower operating position.
Figure 3:
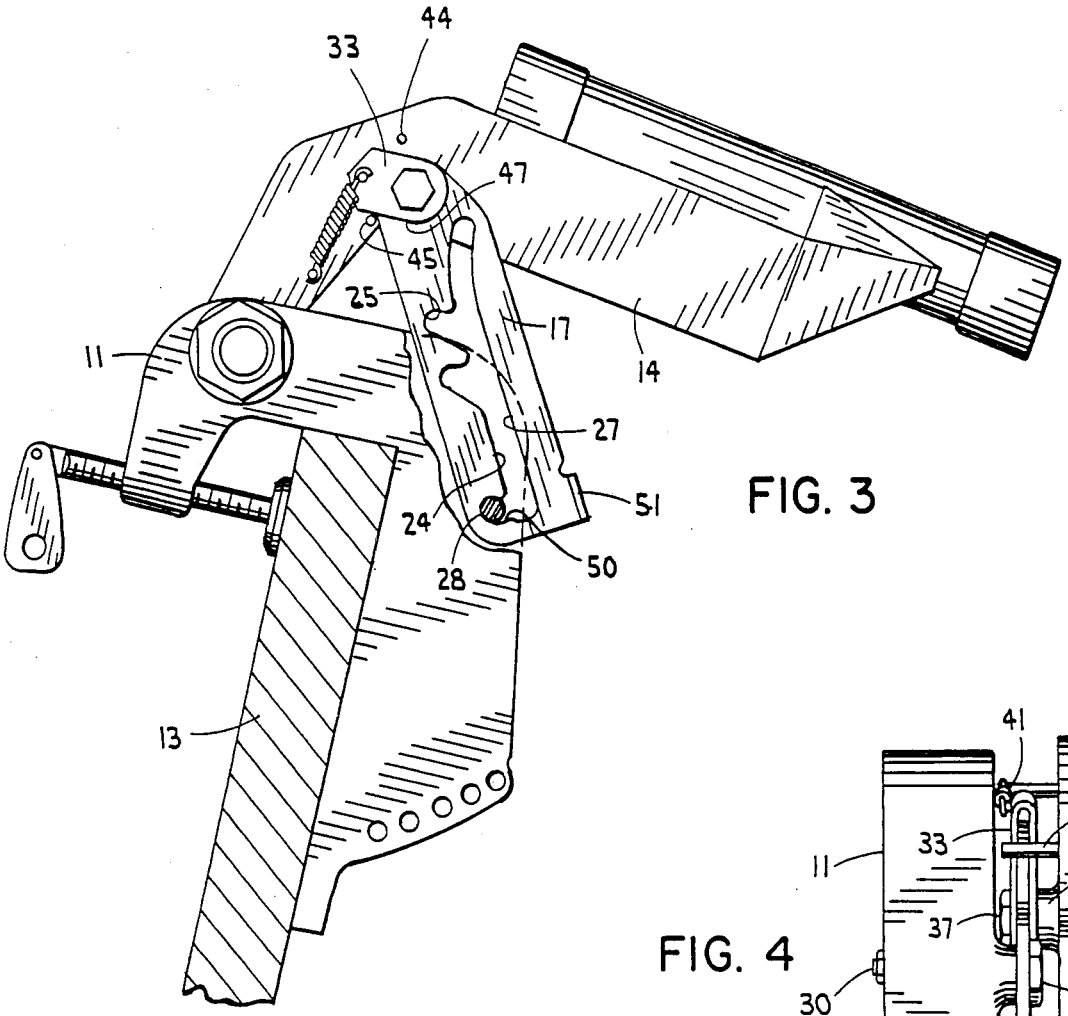
FIG. 3 is a sectional side elevation similar to FIGS. 1 and 2 showing the mechanism set in the upper maximum tilt position.
Figure 4:
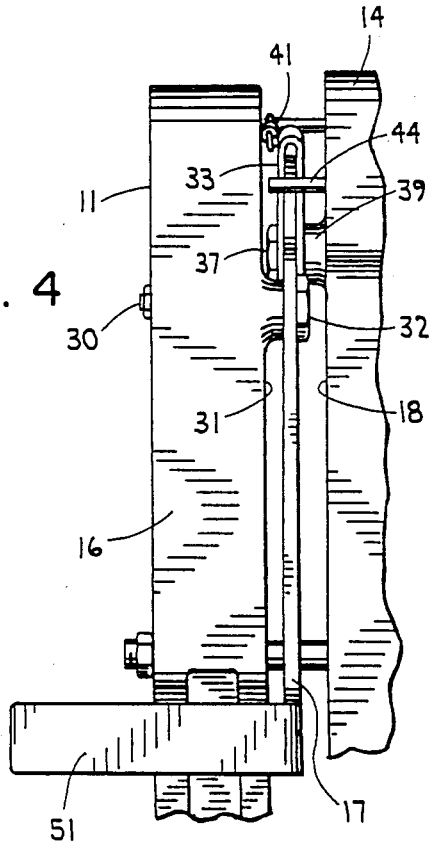
FIG. 4 is an enlarged front view of the tilt mechanism.
Figure 5:
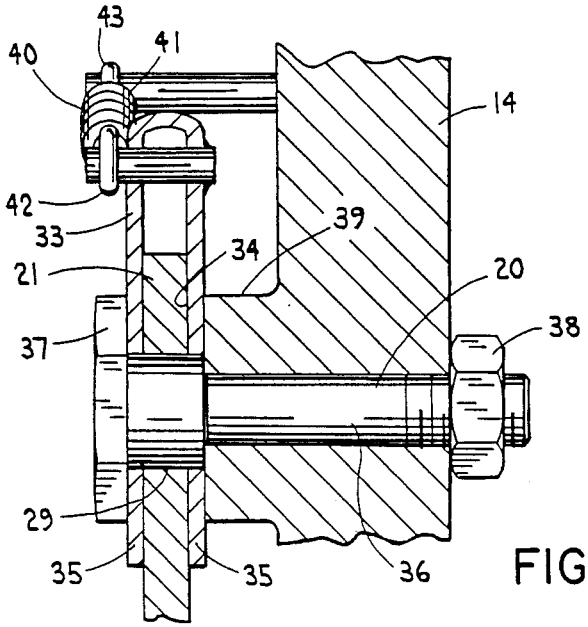
FIG. 5 is a generally vetical enlarged section taken on line 5—5 of FIG. 1.

In the drawing, a tilt mechanism 10 for an outboard motor includes a transom bracket 11 having a pair of clamps 12 for detachably mounting the motor to the transom 13 of a boat. A swivel bracket 14 is pivotally attached to the transom bracket by a pivot tube 15 for rotation about a generally horizontal first axis. An outboard drive unit (not shown) is mounted on the swivel bracket 14 in a conventional manner for tilting movement with the swivel bracket about the horizontal axis of the pivot tube 15. The transom bracket 11 includes a pair of clamping members 16 held in a spaced relationship by the pivot tube 15 and between which the swivel bracket 14 rotates from a lower operating position, as shown in FIG. 1, to an upper maximum tilt position, shown in FIG. 3. The portion of the assembly thus far described is conventional and typical of many outboard motors.

A tilt position bracket 17 is attached to one of the lateral faces 18 of the swivel bracket 14 for rotation with respect to the swivel bracket about a second horizontal axis parallel to the axis of the pivot tube 15. The tilt position bracket 17 is pivotally mounted on a pivot pin 20 attached to and extending through the lateral face 18 of the swivel bracket. The tilt position bracket 17 includes a downwardly depending body 21 in which an open slot 22 is formed. The slot 22 defines a cam track 23 one side 24 of which includes a series of generally vertically spaced tilt position notches 25 and the other side 26 of which defines a return surface 27. A cam track follower 28, which may comprise a short cylindrical stud 30, is attached to the inside face 31 of the clamping member 16 adjacent the lateral face 18 of the swivel bracket 14. The cam track follower 28 extends into the slot 22 defining the cam track 23 for movement therein in response to rotation of the swivel bracket 14, which movement also causes rotation of the tilt position bracket 17 about pivot pin 20 with respect to the swivel bracket 14. The outer free end of the stud 30 is provided with a wide flat cap 32 which is wider than the slot 22 and serves to retain the cam track follower 28 in the cam track 23.

A control bracket 33 is also pivotally attached to the swivel bracket 14 on the pivot pin 20. The control bracket 33 is of a generally flat U-shaped construction adapted to straddle the upper end of the tilt position bracket with the pivot pin 20 extending through the legs 35 thereof, and the flat faces 34 of the legs lying against the body 21 of the tilt position bracket surrounding the pivot pin 20. The control bracket 33 is made of a resilient material, such as spring steel, and fabricated to fit tightly over the tilt position bracket and provide frictional engagement between the flat inside faces 34 of the control bracket legs and the opposing faces of the tilt position bracket 17.

The pivot pin 20 preferably comprises a bolt 36 having a flat head 37 disposed adjacent to the outer face of the control bracket 33 and an enlarged shoulder 29 having an axial length just slightly greater than the combined thicknesses of the body 21 of the tilt position bracket 17 and the legs 35 of the control bracket 33. The bolt extends through the face 18 of the swivel bracket 14 for receipt of a nut 38 on the inside of the swivel bracket. The frictionally engaged brackets 17 and 33 rotate freely on the shoulder 29 and together about the pivot pin 20. A cylindrical boss 39 on the swivel bracket surrounding the bolt 36, serves to space the control bracket/tilt position bracket assembly from the face 18 of the swivel bracket 14.

Figure 2:
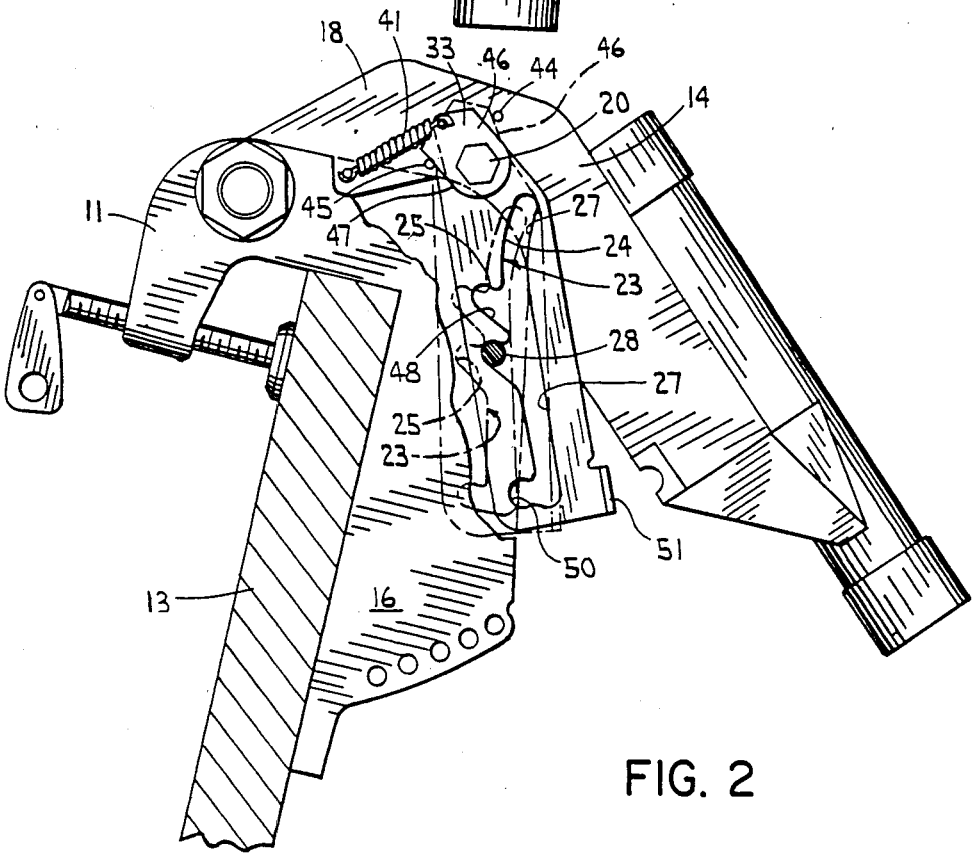
FIG. 2 is a sectional side elevation similar to FIG. 1 showing the mechanism set in an intermediate tilt position.

A resilient biasing means 40, in the form of a tension spring 41, is attached by its ends 42 and 43 to the upper end of the control bracket 33 and the swivel bracket 14, respectively. The force of the tension spring 41 tends to bias the control bracket 33 and the tilt position bracket 17 to which the control bracket is frictionally clamped in the counterclockwise direction as viewed in FIGS. 1–3. A first stop 44 and second stop 45 are attached to the face 18 of the swivel bracket 14 on either side of and spaced from the edges of the control bracket 33. The stops 44 and 45 may comprise solid pins, roll pins, or the like and must be of a sufficient length to be engaged by the edges of the control bracket as it rotates relative to the swivel bracket 14 and/or the tilt position bracket 17, as will be described in more detail hereinafter.

With the tilt mechanism positioned with the swivel bracket 14 in the lower operating position, as shown in FIG. 1, the cam track follower 28 is at the top of the slot 22 in the tilt position bracket 17. As the swivel bracket 14 is raised upwardly, by pivoting the same in a counterclockwise direction around the pivot tube 15, there will be relative sliding movement between the cam track follower 28 and the cam track 23, as the tilt position bracket 17 moves upwardly with the swivel bracket. As the cam track follower 28 moves along the one side 24 of the cam track 23, the tilt position bracket 17 will be caused to rotate in a clockwise direction relative to the swivel bracket 14 to which it is pivotally attached by the pivot pin 20. The frictional engagement will cause the control bracket 33 to rotate with the tilt position bracket 17 in the clockwise direction against the bias of tension spring 41. The tilt position bracket and control bracket will continue to rotate together in the clockwise direction relative to the swivel bracket 14 until the edge 46 of the control bracket comes into contact with the first stop 44. Continued upward movement of the swivel bracket will result in relative clockwise rotation of the tilt position bracket with respect to the swivel bracket, but engagement of the control bracket with the first stop 44 will prevent its relative rotation with respect to the swivel bracket and, as a result, the control bracket 33 will rotate with respect to the tilt position bracket in a counterclockwise direction around pivot pin 20. This relative rotation between the control bracket and the tilt position bracket will continue as the cam track 23 in the tilt position bracket moves upwardly along and with respect to the cam track follower 28. However, when the cam track follower reaches the first tilt position notch 25 the bias of tension spring 41 will cause the combination of the control bracket 33 and tilt position bracket 17 to rotate in a counterclockwise direction around pivot pin 20 and result in engagement of the cam track follower in the first tilt position notch 25 (the uppermost of the two notches shown).

When it is desired to move the outboard motor from the tilt position established by the first tilt position notch, the swivel bracket 14 is again rotated upwardly about the pivot tube 15, the cam track follower 28 bears against the lower surface 48 of the tilt position notch, and the tilt position bracket 17 again rotates in a clockwise direction relative to the swivel bracket. Control bracket 33 will initially rotate in the clockwise direction with the tilt position bracket 17 until the edge 46 of the control bracket again engages the first stop 44. Engagement will occur while the cam track follower is still on the lower surface 48 of the tilt position notch from which it is being disengaged and, therefore, the control bracket 33 will begin to rotate counterclockwise relative to the tilt position bracket 17 to a point where the cam track follower 28 is about to enter the next lower tilt position notch 25 (representing the next higher motor tilt position), as shown in the dashed lined position in FIG. 2. If, at this point, upward movement of the swivel bracket is stopped and it is rotated downwardly in the reverse direction, the bias of tension spring 41 will again rotate the tilt position/control bracket assembly in a counterclockwise direction but, because of the additional relative rotation of the control bracket with respect to the tilt position bracket which occurred just prior to reversal of the direction of movement of the swivel bracket, the other edge 47 of the control bracket 33 will engage a second stop 45 before there is enough counterclockwise rotation of the tilt position/control bracket assembly to allow the first tilt position notch 25 to reengage the cam track follower 28. Instead, the cam track 23 will move relatively downwardly with respect to a cam track follower, the latter will engage and move along the return surface 27 in the cam track, and the assembly will return to the full down position shown in FIG. 1. Relative movement of the cam track follower 28 along the return surface 27 will cause the tilt position bracket 17 to rotate counterclockwise with respect to the downwardly moving siivel bracket 14, but engagement between the edge 47 of the control bracket 33 and the second stop 45 will cause relative rotation of the control bracket in a clockwise direction with respect to the tilt position bracket, until the swivel bracket reaches the fully lowered position and the tilt position/control bracket assembly is rotated to the FIG. 1 position.

Referring once again to FIG. 2, if the swivel bracket is continued to be rotated upwardly from the dashed line position of the cam track 23, the bias of tension spring 41 will again cause counterclockwise rotation of the control bracket and tilt position bracket (frictionally clamped to rotate together) and engagement of the next lower notch 25 and the cam follower 28. Subsequent upward lifting of the swivel bracket will result in relative upward movement of the lower surface 48 of the tilt position notch with respect to the cam follower, as previously described. Corresponding relative clockwise rotation of the tilt position bracket and control bracket will take place until the edge 46 of the control bracket again engages the first stop 44 in the same manner as previously described. Continued upward rotation of the swivel bracket and corresponding upward movement of the tilt position bracket, with the side 24 of the cam track 23 moving along the cam follower 28, will result in further relative rotation of the tilt position bracket in a clockwise direction with respect to the swivel bracket and the control bracket, the latter restrained from rotation with the tilt position bracket because of its engagement with the first stop 44.

When the swivel bracket has been tilted upwardly until the lowermost notch in the position control bracket or trailering notch 50 (representing the fully tilted up position of the outboard motor) has reached the cam track follower 28, the bias of tension spring 41 will again cause the control bracket/tilt position bracket assembly to rotate and the cam track follower to engage the trailering notch 50. In the preferred embodiment shown in the drawings, however, automatic return to the down position from the trailering position is not provided, in contrast to the automatic return to the down position which may be accomplished from an intermediate tilt position provided by the tilt position notches 25, as previously described. This is to prevent inadvertant disengagement of the cam track follower from the trailering notch 50 as a result of a bump or jarring of the motor encountered while the boat is being trailered over the road. However, automatic release from the trailering position and return to the fully down position could be provided, if desired.

When it is desired to release the mechanism from the trailering position, a handle 51 on the lower end of the tilt position bracket 17 is grasped by the operator to manually rotate the tilt position bracket in a clockwise direction, while the swivel bracket is lifted slightly, to disengage the cam track follower from the trailering notch 50. Lowering of the swivel bracket 14 will cause the cam track follower 28 to ride along the return surface 27 on the other side of the cam track 23, the biasing effect of the tension spring 41 being precluded by engagement between the edge 47 of the control bracket 33 and the second stop 45. As the tilt position bracket 17 moves downwardly with the cam track follower riding along the return surface 27, the tilt position bracket will rotate counterclockwise with respect to the swivel bracket and, because relative rotation of the control bracket 33 in that direction is precluded by virtue of its engagement with the second stop 45, rotational movement of the tilt position bracket with respect to the control bracket will eventually return the two to their FIG. 1 position as the cam track follower reaches the upper end of the slot 22 defining the cam track.

Although the means for biasing the tilt position bracket/control bracket assembly, to cause one of the tilt position notches 25 or the trailering notch 50 to engage the cam track follower 28, has been described with regard to the tension spring 41, other types of biasing means may also be used. For example, a torsion spring coiled around the pivot pin 20 and having a free end disposed in biased engagement with the edge 46 of the control bracket 33 would provide a biasing effect similar to that provided by the tension spring 41.

The tilt mechanism of the present invention utilizes relatively few parts as compared to prior art mechanisms, yet provides most of the important functions provided by prior art devices, including upward ratcheting to provide sequential upward movement of the motor for trimming or shallow water operation, automatic return from any one of these intermediate positions, and automatic latching in the uppermost trailering position. As previously indicated, automatic return from the trailering position could also be provided, but with some sacrifice in the security with which the motor is latched in this position. Although only two tilt position notches 25 are shown, more could obvioulsy be provided along the one side 24 of the cam track 23.

Various modes of carrying out the present invention are contemplated as being within the scope of the following claims particularly pointing out and distinctly claiming the subject matter which is regarded as the invention.

I claim:

1. A tilt mechanism for a marine propulsion device comprising:

a swivel bracket pivotally attached to a transom bracket for tilting the propulsion device about a horizontal axis between a lower operating position and an upper trailering position;

resiliently biased cam track means pivotally attached to one of said transom bracket and swivel bracket and including tilt position notches for latching said propulsion device in selected intermediate tilt positions between said lower and upper positions and an upper trailering position notch;

cam track engaging means on the other of said transom bracket and swivel bracket for serially engaging each of said tilt position notches in response to upward tilting of the swivel bracket and biased pivotal movement of the cam track means; and, control means disposed for limited pivotal movement with the cam track means and disposed in frictional engagement therewith to rotate relative thereto for preventing reengagement between said engaging means and an intermediate tilt position notch after upward tilting of the swivel bracket past said notch and opposite downward tilting of the swivel bracket toward said lower position, whereby automatic unlatching from an intermediate position and direct return of the swivel bracket to the lower operating position is effected.

2. The appartaus as set forth in claim 1 including stop means engageable by said control means for overcoming said frictional engagement and rotatably positioning the control means with respect to the cam track means and for limiting the resiliently biased pivotal movement of the cam track means.

3. The apparatus as set forth in claim 2 wherein said stop means includes a first stop engageable in response to upward tilting of the swivel bracket and rotation of the cam track means in one direction, about its pivotal attachment, and a second stop engageable in response to common resiliently biased rotation of the cam track means and the control means in the other direction.

4. The apparatus as set forth in claim 3 wherein the cam track means comprises a tilt position bracket pivotally attached to the swivel bracket and the cam track engaging means comprises a cam track follower attached to the transom bracket.

5. The apparatus as set forth in claim 1 wherein said cam track means terminates adjacent the upper trailering position notch, whereby upward tilting of the swivel bracket past the upper trailering position notch and automatic unlatching therefrom are prevented.

6. A tilt mechanism for a marine propulsion device comprising:

a transom bracket for attachment to a boat transom;

a swivel bracket pivotally attached to the transom bracket for rotation about a first horizontal axis between a lower operating position and an upper maximum tilt position;

a tilt position bracket pivotally attached to the swivel bracket for rotation about a second horizontal axis;

a slot in one of the transom bracket and the tilt position bracket defining a cam track including one side having a series of spaced tilt position notches and an opposite side defining a return surface;

a cam track follower attached to the other of the transom bracket and the tilt position bracket and extending into the cam track for movement therein in response to rotation of the swivel bracket such that engagement between the cam track and cam track follower causes rotation of the tilt position bracket about said second horizontal axis;

a control bracket pivotally attached to the swivel bracket and the tilt position bracket for rotation about said second horizontal axis, said control bracket disposed in frictional engagement with the tilt position bracket for rotation therewith between first and second stops;

resilient biasing means operatively attached to the control bracket for rotating the control bracket and tilt position bracket in one direction such that said one side of the cam track including said tilt position notches is biased into engagement with the cam track follower;

said first stop disposed on the swivel bracket and engageable by the control bracket to limit the rotation thereof in the other direction with the tilt position bracket after initial upward rotation of the swivel bracket from its lower operating position and to cause relative rotation between the control bracket and tilt position bracket with continued upward rotation of the swivel bracket; and, said second stop disposed on the swivel bracket and engageable by the control bracket in response to downward rotation of the swivel bracket to limit rotation of the control bracket and the tilt position bracket in said one direction and prevent engagement between portions of said one side of the cam track and the cam track follower as the follower moves in the track past said portions.

7. The apparatus as set forth in claim 6 wherein the series of tilt position notches includes a notch defining the maximum tilt position.

8. The apparatus as set forth in claim 7 wherein the notch defining the maximum tilt position is disposed to positively latch the swivel bracket against inadvertant displacement from said position.

9. The apparatus as set forth in claim 8 including means for manually releasing the tilt position bracket from engagement with the cam track follower in the maximum tilt position.

10. The apparatus as set forth in claim 9 wherein the manual release means comprises a handle attached to the tilt position bracket.

11. The apparatus as set forth in claim 6 wherein the cam track is disposed in the tilt position bracket and the cam track follower is attached to the transom bracket.

12. The apparatus as set forth in claim 9 wherein the resilient biasing means comprises a spring attached at one end to the control bracket and at the other end to the swivel bracket.

* * * * *